US006195946B1

(12) United States Patent
Lott et al.

(10) Patent No.: US 6,195,946 B1
(45) Date of Patent: Mar. 6, 2001

(54) FORMING APPARATUS AND METHOD FOR THERMALLY INSULATED CONCRETE WALL

(75) Inventors: Johnnie P. Lott, Winter Garden; Cornelius P. Van Horn; Kenneth C. Van Horn, both of Orlando, all of FL (US)

(73) Assignee: Lott's Concrete Products, Inc., Winter Garden, FL (US)

( * ) Notice: Subject to any disclaimer, the term of this patent is extended or adjusted under 35 U.S.C. 154(b) by 0 days.

(21) Appl. No.: 09/314,419

(22) Filed: May 18, 1999

Related U.S. Application Data

(63) Continuation-in-part of application No. 08/808,110, filed on Feb. 28, 1997, now Pat. No. 5,924,247.

(60) Provisional application No. 60/018,544, filed on May 29, 1996.

(51) Int. Cl.[7] ..... E04B 2/24; E04B 2/00; E04C 1/00

(52) U.S. Cl. ..... 52/100; 52/309.7; 52/309.16; 52/309.17; 52/379; 52/380; 52/421; 52/437; 52/505; 52/561; 52/607; 52/742.14; 52/309.12; 52/439; 264/35

(58) Field of Search ..... 52/309.7, 309.16, 52/309.17, 379, 380, 421, 425, 437, 438, 439, 503, 504, 505, 561, 576, 606, 607, 742.14, 309.12, 100; 264/35

(56) References Cited

U.S. PATENT DOCUMENTS

| | | | |
|---|---|---|---|
| 2,216,875 | * | 10/1940 | Cline . |
| 2,745,276 | | 5/1956 | Kuhlman . |
| 2,900,814 | | 8/1959 | Carson . |
| 2,951,318 | | 9/1960 | Sedlak . |
| 3,314,208 | | 4/1967 | Robertson et al. . |
| 3,552,076 | | 1/1971 | Gregori . |

(List continued on next page.)

FOREIGN PATENT DOCUMENTS

| | | |
|---|---|---|
| 295 11 542 U1 | 12/1995 | (DE) . |
| 2267430 | 11/1975 | (FR) . |
| 2460374 | 1/1981 | (FR) . |
| 1169723 | 11/1969 | (GB) . |

*Primary Examiner*—Robert Canfield
(74) *Attorney, Agent, or Firm*—Allen, Dyer, Doppelt, Milbrath & Gilchrist, P.A.

(57) ABSTRACT

A construction form for building an insulated concrete reinforced wall includes separable and independently usable lintel block and post block sections, made from injection molding Styrofoam. The lintel block section includes a channel extending horizontally and fully along its top portion. The channel includes multiple knock-out plugs within the bottom wall. The lintel block section also has multiple parallel and vertically spaced apertures with one end opened at a lower end, and extending upward to a closed end terminating at one plug within the bottom wall of the channel. The post block section is stackable with the lintel block section. The post block section includes multiple, vertically disposed apertures extending entirely through the lintel block section and horizontally disposed for aligning with the apertures of the lintel block section, Each of the apertures of the post block section are aligned with each of the apertures of the lintel block section when the sections are stacked directly over each other. In addition, the apertures are horizontally spaced to accommodate horizontal off-sets in increments of one foot for providing further alignment of the apertures when the multiple sections are used to create various desirable off-set section combinations in the construction of a wall. The channel receives molten concrete for forming a horizontal beam or lintel. By knocking out a selected plug, the molten concrete will flow into and fill a selected aperture for forming a concrete post or column within the wall.

31 Claims, 10 Drawing Sheets

U.S. PATENT DOCUMENTS

| | | | | |
|---|---|---|---|---|
| 3,788,020 | | 1/1974 | Gregori . | |
| 3,872,636 | | 3/1975 | Nicosia . | |
| 3,922,828 | | 12/1975 | Patton . | |
| 4,075,808 | * | 2/1978 | Pearlman | 52/439 |
| 4,223,501 | | 9/1980 | DeLozier . | |
| 4,532,745 | | 8/1985 | Kinard . | |
| 4,604,843 | | 8/1986 | Ott et al. . | |
| 4,879,855 | | 11/1989 | Berrenberg . | |
| 4,889,310 | | 12/1989 | Boeshart . | |
| 5,231,813 | | 8/1993 | Drawdy . | |
| 5,247,773 | | 9/1993 | Weir . | |
| 5,329,741 | | 7/1994 | Nicolaidis et al. . | |
| 5,404,685 | | 4/1995 | Collins . | |
| 5,440,846 | | 8/1995 | Record . | |
| 5,465,542 | | 11/1995 | Terry . | |
| 5,596,857 | | 1/1997 | Besche . | |
| 5,678,373 | * | 10/1997 | Franklin et al. | 52/439 |
| 5,699,640 | * | 12/1997 | Bourgeois et al. | 52/309.4 |
| 5,839,243 | * | 11/1999 | Martin | 52/439 |
| 5,924,247 | * | 7/1999 | Van Horn et al. | 52/100 |
| 5,950,397 | * | 11/1999 | Ginn et al. | 52/742.14 |
| 5,992,102 | * | 11/1999 | Ozawa | 52/100 |

* cited by examiner

FORMING APPARATUS AND METHOD FOR THERMALLY INSULATED CONCRETE WALL

CROSS REFERENCE TO RELATED APPLICATION

This application is a continuation-in-part of application Ser. No. 08/808,110 filed Feb. 28, 1997 and issuing as U.S. Pat. No. 5,924,247 for "Lightweight Structural Panel Configured To Receive Poured Concrete And Used In Wall Construction," commonly owned with the present invention, the disclosure of which is herein incorporated by reference which claims benefit under 35 U.S.C. 119(e) of provisional application Ser. No. 60/018,544 filed May 29, 1996.

FIELD OF THE INVENTION

The invention relates generally to building construction and, more particularly, to the fabrication of a thermally-insulated concrete wall using an insulating material, such as polystyrene plastic, configured as a concrete form for receiving poured concrete therein and for remaining with the set concrete for forming the insulated wall.

BACKGROUND OF THE INVENTION

For several generations now it has been known to use concrete blocks of a standard size in the construction of walls, homes, apartment houses, office buildings and many other structures. Although block size can vary in accordance with the particular use, one standard size of concrete block measures 8"×8"×16", and has two rather large cavities separated by the center web of the block. Further, for reasons of strength, it is well known to place the concrete blocks in a staggered relationship when constructing a wall, with one layer or tier of blocks offset by approximately 8" from the tier directly below it. The configuration of these standard size concrete blocks is such that the cavities of the numerous blocks used in the construction of a wall are vertically aligned.

Many building codes pertaining to both residential and commercial buildings require a special construction technique where one wall portion intersects another wall portion, such as in a 90° relationship. Reinforcing bars (rebar) are frequently inserted into the block cavities defined at the corners where one wall intersects the other. Concrete is then poured into the intersecting cavities of the blocks located at such corner. Another important constructional technique required by most building codes is the pouring of a lintel along the top of the substantially completed block wall. In this instance, channel-type concrete blocks are used as the top member of each wall portion, with rebar placed horizontally in the aligned channels extending along each wall portion. Bent rebar is used at each corner. Concrete is then poured into the channel-type concrete blocks located along the top of each wall, with the bent rebar placed at each corner for preventing the corners from separating. This type of construction is much stronger than would have been the case if the concrete blocks had not been topped off with poured concrete, and the intersecting corners had not been suitably reinforced.

In addition, various methods for providing lightweight and insulating walls through a concrete form construction are also known. Such efforts have been made to avoid the cost and labor expense involved in the creation of walls constructed of concrete blocks. U.S. Pat. Nos. 3,788,020 for a "Foamed Plastic Concrete Form With Fire Resistant Tension Member" and 3,552,076 for a "Concrete Form" to Gregori are examples of such methods. A self-supporting concrete form of foamed polymeric material is molded in one piece and includes two spaced longitudinal walls. Partitions are used along the length of the concrete form in order to form vertically disposed apertures for receiving molten concrete. Although it is known to use reinforcement for the concrete poured into vertically disposed apertures, it is to be seen that typical molds are not much taller than the height of conventional concrete blocks, which extends the length of time needed for the creation of a wall. Further, there is a need for a trough-like recess extending along the upper section of such molds for receiving molten (wet) concrete, and further need for a technique wherein a builder is able to economize in the use of concrete by selecting only certain vertically disposed apertures of his molds to receive the molten concrete. The '020 patent discloses the use of metal members bridging between the side wall members of the concrete form, thus increasing labor costs as well as material costs.

U.S. Pat. No. 3,872,636 to Nicosia, entitled "Light Weight Load Bearing Metal Structural Panel" and the U.S. Pat. No. 4,223,501 to DeLozier, entitled "Concrete Form," disclose the use of concrete forms of lightweight material typically requiring metal members for strengthening purposes, which necessarily increase the cost of materials and labor.

By way of further example, U.S. Pat. No. 4,604,843 to Ott et al., entitled "Lost-Form Concrete Falsework" discloses the use of insulating slabs of foam material that are held in an upright orientation in a spaced apart relationship so that concrete can be poured therebetween. The use of a ladder-like elements for holding the slabs of foam material in the properly spaced relationship causes such a wall form to be quite heavy prior to pouring the concrete, and the amount of concrete needed in the construction of the wall cannot be effectively varied in accordance with the needed strength of the wall. U.S. Pat. No. 4,879,855 to Berrenberg, entitled "Attachment and Reinforcement Member for Molded Construction Forms" discloses a form held together by expanded metal mesh. Such arrangements can be expensive, especially when one cannot select a desirable amount of concrete sufficient for meeting the needs of the wall. Similar techniques are suggested in U.S. Pat. No. 4,889,310 to Boeshart, entitled "Concrete Forming System" in which opposed polystyrene panels are stacked to form a pair of parallel, spaced apart walls held apart by tie members, with concrete to be poured between the members. As a result, an unnecessarily heavy wall results, rather than a lightweight sufficiently load-bearing wall in which the amount of concrete utilized in the wall can be selectively modified.

Typically, the teachings in the art, as suggested by the above reference patents presented by way of example, do not provide a rapid construction of load-bearing walls, wherein the amount of concrete utilized in the wall can be varied in accordance with the need for strength.

SUMMARY OF THE INVENTION

In view of the foregoing background, it is therefore an object of the present invention to provide for the rapid construction of load-bearing walls, wherein the amount of concrete used in the wall can be varied in accordance with the need for strength. It is further an object to provide a cost effective, finished load bearing wall having an improved thermal insulating value.

It is another an object of this invention to provide a lightweight form usable for the production of a hand poured, steel reinforced, load-bearing wall that is able to be constructed more rapidly and more economically than can a wall of similar strength be created by the use of preformed blocks. It is yet another object to provide a lightweight form for enabling the builder to vary the amount of concrete used in the construction of the wall in accordance with the need for strength. It is yet another object of this invention to provide a series of substantially identical lightweight yet sturdy forms, each provided with a plurality of elongate, generally vertically disposed concrete-receiving apertures, with the upper end of each of the vertically disposed apertures being provided with easily removed blocking means, so that selected ones of such vertically disposed apertures can be filled with concrete as dictated by the needed compressive strength and economic factors.

These and other objects, advantages, and features of the present invention are provided by a construction form of lightweight structural material useful in the construction of a thermally insulated load bearing wall. The form comprises a lintel block section formed of an insulating material. The lintel block section includes an elongate channel formed along a top portion thereof, the channel defined by opposing vertical side walls and a bottom wall having a plurality of plug portions therein. The lintel block section further includes a first plurality of elongate, generally vertically disposed apertures having an open end at a lower most portion of the lintel block section, which apertures extend upwardly to a closed end, each terminating at one plug within the bottom wall of the channel. The form also comprises a post block section operably stackable with the lintel block section. The post block section is formed of the insulating material and includes a second plurality of elongate, generally vertically disposed apertures extending therethrough. The apertures are such that the first and second plurality of elongate apertures are aligned in a first stackable position with each section directly aligned, and wherein a horizontal off-set of the sections, in increments of one foot, provides an alignment of at least one of the first and second plurality of elongate apertures. The channel is adapted to receive and contain molten concrete, with some of the concrete being able to flow into and fill a selected one aperture of the first and second plurality of vertically disposed apertures, when a selected plug is removed from the bottom wall, which selected plug is above the selected one aperture to be filled with the molten concrete.

A preferred embodiment of the form is fabricated in an injection molded manner. By using polystyrene plastic, such as Styrofoam, molded into a rectangular shape, load-bearing walls can be made straighter and faster than is possible using individual concrete blocks. The forms are of consistent size and consistent configuration, each being equipped with a plurality of parallel, generally vertically disposed apertures into which concrete can be poured in the interest of creating a wall having great compressive strength.

Polystyrene plastic is one preferred material, which allows for an injection molded fabrication of the form. Such polystyrene is frequently refer as Styrofoam. However, it is to be understood that the present invention is not limited to Styrofoam. For example, various other lightweight structural materials of the types described, by way of example, in the earlier cited patent references may be used. Among the various structural materials usable in selected circumstances are high density foamed synthetic resins such as expanded polystyrene, extruded polystyrene foam, polyurethane foam, or a foamed phenolformadehyde or like resin.

It is understood that a form constructed of such lightweight structural material used alone would have only a small fraction of the compressive strength of a concrete block wall, but as will be further explained hereinafter, a top edge of each form provided in accordance with the preferred embodiment of this invention is channeled so as to receive rebar, with concrete poured into the channel and into other parts of the form in order to provide the desirable strength to the wall being formed.

The form, in accordance with the present invention, has elongate, generally vertically disposed apertures occurring at regular, preestablished intervals, with these apertures being provided in a closely disposed relationship to the channeled top edge of the form. Rebar is placed, as desired, in these elongate, generally vertically disposed apertures. Therefore, at such time as all of the desired rebar are in place, concrete is poured into the trough-like channel extending along the top edge of the form, with some of the concrete also flowing into and filling the vertically disposed apertures. In this way, columns of concrete are defined at spaced intervals along the wall created by the use of multiple forms. By the liberal use of the rebar in the vertical apertures and along the generally horizontally disposed trough-like channel extending along the top of each form, the resulting wall is even stronger than it would be if concrete blocks were used.

In a preferred embodiment of the invention, the form includes a comparatively thin wall thickness for the separation between the underside of the channel top edge and the top of each of the elongate, generally vertically disposed apertures. In a manner of speaking, these this walls amount to plugs or blockage material of Styrofoam at the top of each vertically disposed aperture of the Styrofoam form, thus to prevent, in the first instance, the filling of such apertures with concrete. As desired, these plugs are removed to permit the flow of concrete down selected vertically disposed apertures, thus permitting the creation of the columnar portions of the wall being created. However, it is to be realized that some walls require great compressive strength whereas other walls do not. It is quite apparent that all of the plugs or blockage components would be removed in instances when extreme compressive strength is required, but if great wall strength is not required in a particular instance, not all of such Styrofoam plugs would be removed. As a result of the non-removal of these plugs, concrete can be saved and the wall created more inexpensively than would have been the case if every vertically disposed aperture of the panel was to be filled with concrete.

The forms have a thickness generally consistent with a concrete block wall, but unlike a typical concrete block wall, the forms do not need to be of any fixed size. For reasons of manufacture, and with regard to the transport of the forms to a job site, they are preferably four feet in length. In some instances, however, each form is six to eight feet in length. It is to be noted that when a particular length and configuration of the form has been selected, a set the forms will be consistently manufactured, and include a height and aperture spacing for placement of a vertically disposed column to be filled with concrete.

With regard to the strength of the wall in the locations between the above-described columns of concrete, after the wall has been completed, stucco can be applied to the outside of the multiple forms, in the interests of providing a desired finish to the wall. Further, wallboard can be applied to inside portions of the wall. Other options include gypsum board, tiles, plywood and the like firmly secured to the longitudinal sides of the panels.

By way of further example, because it is often desirable to pour concrete on 12" and 24" centers, a desirable form length will be four feet, with a middle vertical aperture placed at a location equidistant from ends of the form. On each side of this middle aperture is a vertically disposed aperture, with the center of each of these latter two apertures being 12" away from the center of the middle aperture, thus placing this pair of apertures on 24 inch centers. Outboard of each of the apertures residing on each side of the middle aperture will be a partial aperture, a vertical end channel for juxtaposing with another form having a similar vertical end channel, so as to create an aperture, the center of which is 12" from its adjacent aperture.

These apertures extend from the bottom of the form up approximately 23¼", thereby leaving a 1½" MOL material separating the top of each of the generally vertically disposed cavities from the lower portion of the horizontal cavity or trough-like recess into which the wet concrete is initially poured. In another preferred embodiment, a form having a height dimension of approximately 32" will be divided into two sections, each of 16" height. The top section will include the trough-like recess, the bottom section will include vertical apertures that align the vertical apertures of the top section.

It should be clear that a builder using these novel panels will have the choice or option, at the time concrete is being poured, of removing the inch or more of Styrofoam material blocking the top of selected vertical cavities, such as by the use of a pocket knife, hot wire or the like, thereby enabling the horizontally disposed and the vertically disposed cavities to be joined together in an exceedingly strong manner by the poured concrete. Preferred embodiments include the blocking material formed with tapering edges along the aperture walls for ease in knocking out the blocking material, thus "knock-outs" provide the blocking material to be knocked out as desired for selecting a vertical column of concrete to be poured. Further, when a large quantity of forms are typically used for construction of a wall or building, such as the wall of a home, apartment house, office building or the like, they will be secured together in a stacked relationship, with some brought into an end-to-end relationship, by the use of concrete reinforced by rebar.

It is now to be seen that in accordance with this invention, we have provided basic forms of lightweight structural material and consistent size to be utilized in the construction of a sturdy, load-bearing wall. These basic forms are elongate and generally in the configuration of a rectangular solid, involving a pair of side portions, a pair of end portions, a bottom section, and an upper section. In the preferred embodiment of this invention, a trough-like recess of essentially uniform depth is located along the upper portion, with such trough-like recess being an ideal receptacle into which molten concrete is to be poured after a sufficient number of rebar have been installed.

A plurality of elongate, generally vertically disposed apertures are disposed in an essentially parallel relationship below this trough-like recess, with these apertures being in an essentially perpendicular relationship to the trough-like recess. The trough-like recess is continuous, meaning that the upper end of each of these apertures is separated from the interior of the trough-like recess by a consistent, relatively minor thickness of the lightweight structural material of which each panel is constructed. The trough-like recess is clearly adapted to receive and contain molten concrete, with some of such concrete being able to flow downwardly into and fill only those elongate, generally vertically disposed apertures above which the relatively minor thickness of material has been removed by the user.

BRIEF DESCRIPTION OF DRAWINGS

A preferred embodiment of the invention, as well as alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
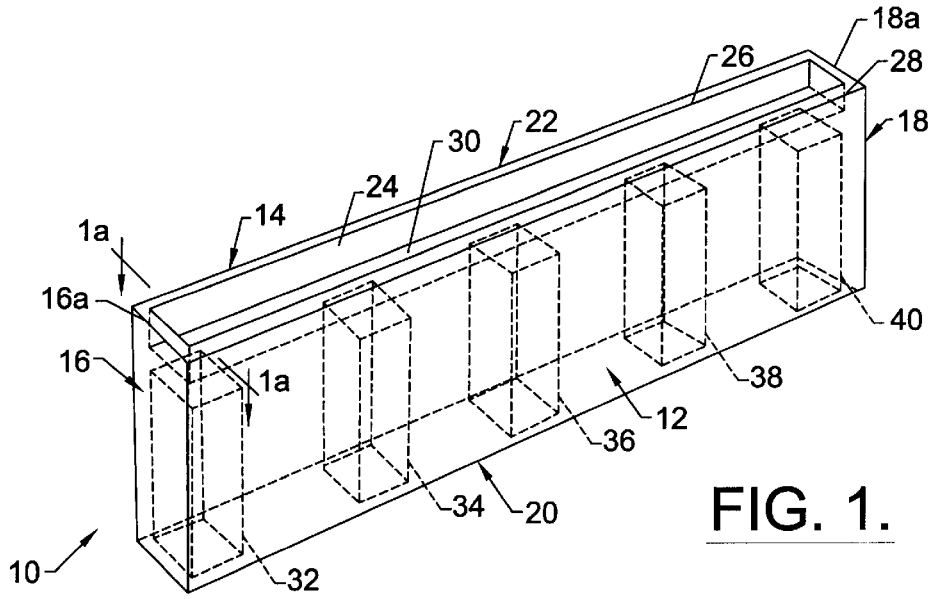
FIG. 1 is a perspective view of one preferred embodiment of a form in accordance with the present invention.

With reference initially to FIG. 1, a concrete form 10 is of lightweight construction to be used in accordance with the present invention, in the construction of a sturdy, load-bearing wall. One embodiment of the form 10 comprises an elongate, generally rectangular shape, having a pair of opposing and generally parallel side walls 12, 14. Styrofoam is a preferred material for forming the form 10 in an injection molding manner. As previously discussed, other lightweight structural materials of the types set forth in the patents cited hereinabove may be used. Among the various structural materials usable in selected circumstances are high density foamed synthetic resins and the like.

With reference again to the embodiment of FIG. 1, the form 10 includes opposing end walls 16 and 18, a lower portion 20, and an upper portion 22. One form 10 includes, by way of example, a 4 foot length dimension and a 32" height dimension for the side walls 12, 14. Alternate sizes will include dimensions to fit the needs of the user, such as an eight foot length useful in the construction of free standing field walls. Despite its lightweight construction, the form 10 becomes an intrinsic part of a load-bearing wall. The form 10 useful in building construction will typically have a width dimensions for the end walls 16, 18 of 7½", 9½", and 11½". Other width dimensions will come to the mind of the user without departing from the intent and teachings of the present invention. Preferred embodiments, herein described by way of example will be approximately three to four times as high as they are wide.

With continued reference to FIG. 1, and in accordance with a preferred embodiment of the present invention, the form 10 includes an elongate trough-like recess or channel 24 being defined between the side walls 12, 14 along the upper portion 22, which trough extends to the end walls 16, 18. The channel 24 extends in a continuous manner generally horizontally along the upper portion 22, and it is into this recess that concrete is to be poured.

Figure 1A:
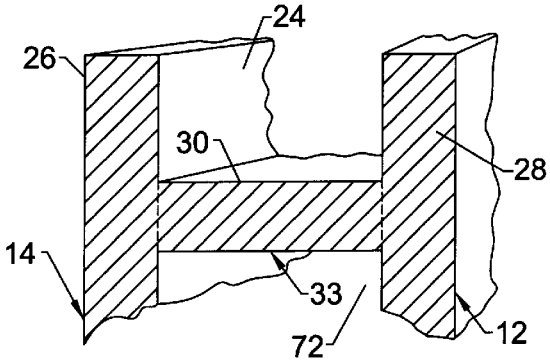
FIG. 1*a* is a partial cross-section view taken through lines 1*a*—1*a* of FIG. 1.

With reference to FIG. 1*a*, the channel 24 may be seen as being principally defined between upper sidewalls 26 and 28, which represent the upper most portions of the side walls 12 and 14. The continuous channel 24 may for example have an inside dimension of approximately 5½", with the upper sidewalls 26 and 28 each being approximately 2" thick for forms 9½" wide, or 1" thick for forms 7½" wide. End members 16*a* and 18*a*, representing upward extensions of the end portions 16 and 18 for the embodiment of FIG. 1, prevent the overflow of concrete from the ends of the channel 24.

With respect to FIG. 1*a* it will be noted that the bottom wall 30 or floor of the channel 24 is provides a barrier between the upper and lower portions 22, 20 of the form 10. The bottom wall 30 may, for example, have a thickness of one to four inches of the lightweight structural material, directly below which are a series of elongate, generally vertically disposed apertures 32, 34, 36, 38, and 40, generally vertical and perpendicular to the longitudinal axis of the channel 24. The one to four inches of lightweight structural material used for the bottom wall 30 serves as readily removable plugs or means for separating the recess 24 from each of the apertures 32, 34, 36, 38, and 40, that in the initial instance represent a blockage serving to prevent the downward flow of concrete from the elongate recess 24 into the vertically disposed apertures.

With reference again the embodiment of FIG. 1, the elongate, generally vertically disposed apertures 32, 34, 36, 38 and 40 extend from the location just below the bottom wall 30 of the channel 24, down to the lower portion 20 of the form 10, which vertical apertures reside in an essentially parallel relationship below the channel 24, being separated from the channel 24 by the above-mentioned relatively minor thickness of the bottom wall. This bottom wall 30 is typically constituted of the same lightweight structural material of which the form 10 is constructed, and is easily removed, when desired, from the locations directly above the generally vertically disposed apertures. A pocket knife or a hot wire is usually sufficient for removal of the Styrofoam at the selected locations above the elongate, generally vertically disposed apertures.

It is to be understood that the channel 24 is continuous at the time the form 10 is manufactured, with this recess being adapted to receive and contain molten concrete. As a result of a builder removing selected portions of the material constituting the bottom wall 30 of the recess 24, some of such concrete is able to flow into and fill certain ones of the generally vertically disposed apertures 32, 34, 36, 38 and 40. By way of example, the builder has the option of removing the plug, bottom wall 30, representing the blockage located directly above only those of the elongate generally vertically disposed apertures that are desired to be used in the creation of strong elongate columns of concrete. The resulting columns of concrete are typically four or so times as high as they are wide.

With regard to wall strength, by way of example, if a wall being constructed using multiple forms 10, needs to be particularly strong, the material constituting the plug, bottom wall 30 will be removed from the location directly above each of the generally vertically disposed apertures, whereas if a wall of lesser strength is to be constructed, concrete can be conserved by not removing the bottom wall 30 of the trough member 24 above every vertically disposed aperture, but only certain desirable apertures. One option may include the pouring of concrete on 24" centers, as will be described hereinafter.

By way of further example, the form 10 can be used for constructing a wall closely resembling the configuration illustrated with reference again to FIG. 1, which of course could be made considerably longer by being joined in an end-to-end relationship with other substantially identical forms 10. When a low height wall is being constructed, the provision of the channel 24 is particularly important, which recess would be filled with concrete and then carefully leveled so as to form a desirable, durable upper surface for the wall. Depending on the use to which the wall is to be put, reinforcing bars, rebar, are be inserted in the vertically disposed apertures and also laid in the channel 24 before the concrete is poured. When the lightweight structural forms 10 are being laid end-to-end, the ends 16*a*, 18*a* will be broken out so that the rebar and concrete can extend continuously from one form 10 to the next adjacent form.

Figure 2:
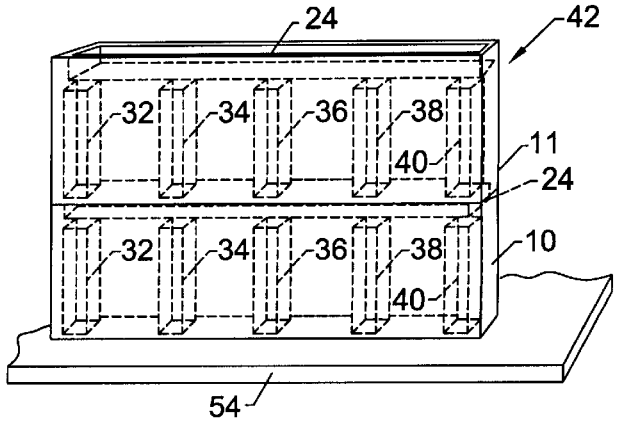
FIG. 2 is a perspective view illustrating a wall having two tiers of the form of FIG. 1 stacked in an aligned position.

With reference to FIG. 2, by way of example, construction of one load bearing partition wall 42 includes the use of multiple forms 10, 11, a second form of lightweight construction stacked atop the first form 10, with their vertical apertures in alignment. The forms 10, 11 are substantially identical, and for convenience, we will refer to the stacked construction depicted in FIG. 2 as involving a first course, form 10, and a second course 11.

For one preferred method of construction of the wall 42, it has been found that it is not necessary for the concrete associated with the first course to be completely set before the form 11 associated with the second course is poured. This is to say, after the channel 24 extending along the upper part of the first or lower course is partially set, generally vertically disposed rebar may be inserted therein. Quite understandably, the rebar will be disposed at a spacing coinciding with the generally vertically disposed apertures of the form 11, or multiple forms constituting the second course of forms. In this way, the load-bearing wall 42 will be created whose first and second courses are integrated together in a sturdy, highly effective manner. The forms 10, 11 of lightweight structural material for each successive course or layer of the wall 42 are arrayed such that their generally vertically disposed apertures, 32, 34, 36, 38, and 40 will be in alignment with the generally vertically disposed apertures of the first course or layer. In this way the completed wall will have columnar strength extending in an essentially continuous fashion all the way from the lowermost portion or section of the wall to the uppermost portion or section of the wall. It is to be understood that in accordance with the present invention, the builder can economize on the amount of concrete used to accommodate the needs of the wall be constructed, in which case only certain ones of the generally vertically disposed apertures located between the elongate sidewalls are to be filled with concrete. Further economy can of course be accomplished by employing forms 10 utilizing the channel 24 only at the top of the wall, as will be described later in this section.

Figure 3:
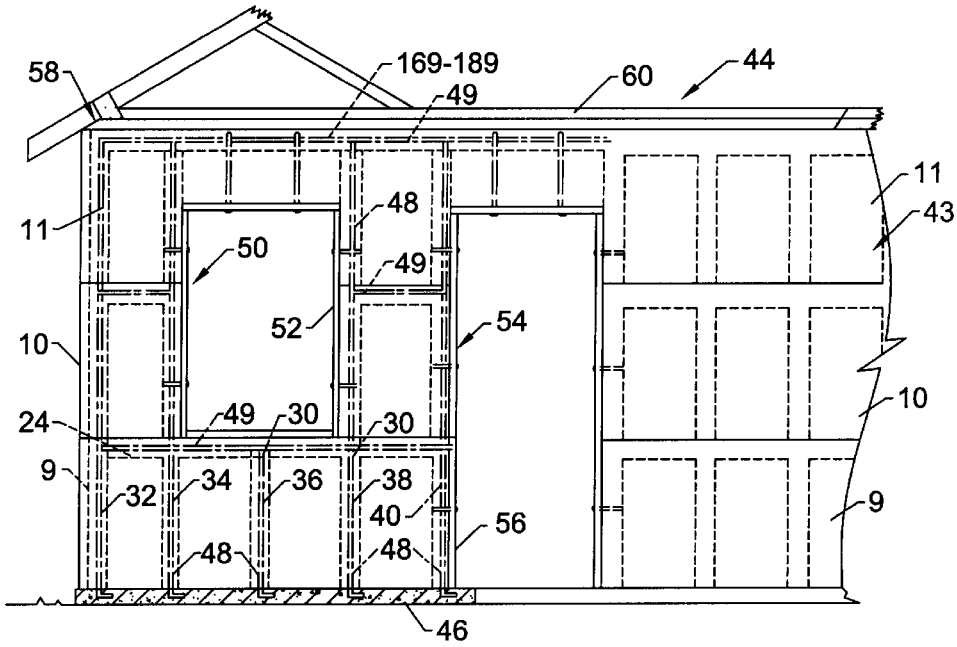
FIG. 3 is an elevation view of the wall of a typical house constructed utilizing the techniques taught in accordance with the present invention using the form of FIG. 1.

By way of example, and with reference to FIG. 3, a plurality of forms 10 of lightweight structural material can be utilized in assembled relation in order to create load-bearing walls 43 utilized for example in the construction of a house 44. Assuming that the wall 43 is to be something on the order of 96" in height, and presuming the utilization of forms 10 approximately 32" in height, then three forms 9, 10, 11 are used in a stacked relationship in the creation of the wall 43. In other words, a second, and then a third basic form of lightweight structural material intended to constitute the second and third layers or courses of the wall are placed upon each of the lowermost forms, that is, the forms in direct contact with a concrete slab 46. In order that the completed wall 43 will possess suitable strength, a suitable amount of concrete must be poured into the lightweight forms 9, 10, 11 of each course or level, as will hereinafter be discussed.

It is apparent from FIG. 3 that we are depicting a wall of a house, but as is obvious, the construction involving our novel forms of lightweight structural material may be effectively utilized in the construction of load-bearing walls for a wide variety of other buildings as well, including small office buildings, motels, condominiums, and the like.

By way of further example, and with reference again to FIG. 3, the construction will typically start with construction of the concrete slab 46, poured to a suitable thickness, with the lower ends of vertically disposed rebar 48 of appropriate size being inserted into the concrete of the slab before it sets. For a reason soon to be apparent, these vertically disposed rebar are utilized in a particular spacing. Then, after the slab 46 has reached a desired degree of firmness, one or more forms 9 is placed over the upstanding rebar 48, such that at least one rebar extending upwardly from the slab resides in each of the generally vertically disposed apertures of the form 9 constituting the lowest course or level of the wall 43. Before any concrete is poured into the channel 24 extending along the top of this lowermost form 9, however, one or more rebar 49 of appropriate size are typically laid in such channel 24. These additional, generally horizontally disposed rebar 49 residing in the channel 24 may or may not be directly tied in with the rebar 48 extending upwardly from the slab 46 at essentially right angles to the recess 24, through the generally vertically disposed apertures 32, 34, 36, 38, and 40 of the lowermost form 9.

As previously mentioned, the builder has the option of cutting into the bottom wall 30 of the channel 24 so as to open the upper end of selected ones of the generally vertically disposed apertures of each form or panel. Quite understandably, when the blockage is removed and the concrete has been poured into the channel 24 extending along the top of each form, the concrete will pour into and fill only the selected vertically disposed apertures. Where the recess bottom wall 30 remains intact in the form of a plug or blockage above a given vertically disposed aperture, no concrete flows into that vertically disposed recess. The more of the apertures 32, 34, 36, 38, and 40 that are opened, the greater will be the strength of the wall. Typically in the construction of a building, all apertures will not includes poured concrete, and concrete will not likely be poured into a generally vertically disposed aperture of the second or third course or level unless concrete had previously been poured into the corresponding generally vertically disposed recess located directly below. Where economy is a primary factor, and great wall strength is not needed, it is possible, in mid portions of a wall, to use forms 10 that do not contain the continuous channel 24, and do not include any concrete therein.

By way of further example, and with reference again to FIG. 3, a window 50 is inserted at a location directly above the lightweight form in direct contact with the concrete slab 46. In order that the window 50 can be incorporated into the construction of the wall 43, a desired spacing must be observed in the placement of the next layer or form 10 in order that the frame 52 of the window 50 may be accommodated. It is typical that rebar 48 extend for the full height of the wall 43 of the house or other building. Before the concrete associated with the first layer or course, forms 9, of the wall 43 has set, the lightweight forms 10, associated with the second layer or course of the wall are placed in properly aligned relationship upon the forms 9 constituting the first course, with rebar 48 then being inserted down through the generally vertically disposed apertures 32, 34, 36, 38, and 40 of the second course and into the concrete of the channel 24 of the first course. It is typical that the lightweight forms to be utilized in the construction of each course or layer of a given wall will be carefully in place before the concrete for that course or layer is poured, so in the case of FIG. 3, the lightweight forms directly contacting the slab 46 will be in place and filled with concrete to the fullest extent desired before the forms constituting the second course or layer have been added. With a door 54 incorporated into the wall 43, the first lightweight forms 9 will be positioned or cut to size for insertion of a frame 66 to be utilized for receiving a door.

In a manner resembling that described with regard to FIG. 2, when constructing the wall depicted in FIG. 3, it is obvious that after the concrete of the first course has substantially set, the forms 50 constituting the second course are then placed in carefully aligned relation upon the forms 10 of the first course, with the generally vertically disposed apertures of the courses being in alignment. After the rebar 48 have been inserted into the apertures of the second course, concrete is then poured into the channel 24 of each of the second course forms, with concrete flowing down into the generally vertically disposed apertures whose upper portions have been uncovered.

Rebar 49 are laid in a generally horizontal manner in the channel 24 of each of the lightweight forms constituting the second course or level of the load-bearing wall. As previously discussed, ends 16*a*, 18*a* are broken so that the rebar 49 and concrete can extend continuously between one lightweight structural panel 11 and the next lightweight structural panel with which it is in an end-to-end relationship.

After the second course or level of the load-bearing wall 43 has been substantially completed by the pouring of concrete, the lightweight forms 11 constituting the third course are then to be added, with the vertically disposed apertures of each of the forms being in substantial alignment with the apertures of the forms 10 therebelow. It has previously been mentioned that it is not necessary for the concrete of a lower course to have completely set before the concrete associated with the next course is poured. This is particularly true in an instance in which it is desired for the rebar of one course to be carefully integrated into the concrete of the form immediately below.

At this point it is to be recalled that in describing the wall of single height depicted in FIG. 1, it was mentioned that the channel 24 is completely filled and leveled, but it is also to be noted that it is not always necessary to fill the channel 24 of the lowermost form and the middle form of a wall utilizing lightweight forms utilized on three separate levels. In other words, in economizing on the use of concrete, it may be desirable to insert an elongate, generally horizontally disposed filler member such as a piece of Styrofoam into the channel 24 of a lower panel of the wall, to lessen somewhat, the demand for concrete for the channel 24. This of course is an alternative to the aforementioned economy version of our invention in which the channel 24 has been eliminated from the forms or panels utilized in an intermediate level of a wall. The type of construction utilizing either a horizontally-disposed filler member, or in the utilization of forms from which the channel 24 has been eliminated are manifestly to be used only when great wall strength is not a requisite.

Returning to the construction depicted in FIG. 3, it is understood that the lightweight forms 11 constituting the uppermost course or level of the wall will have their respective channels 24 completely filled with concrete after, of course, the desired number of rebar have been inserted. The filling of the channel 24 of the uppermost forms 11 is of particular importance inasmuch as it is desired for the concrete poured into the uppermost channels 24 to be leveled so as to form a proper support for roof members, including plates. As will be familiar to those concerned with the construction of houses and other buildings, large threaded bolts are often placed in a vertical relationship in the concrete constituting the uppermost edge of a block wall or the like. Holes are drilled into corresponding positions in the wooden plates 60, typically treated 2"×10" lumber, so that the plates can be firmly bolted to the top of the wall. Upon the plates 60 being bolted to the wall, they are ready to receive the members 58 constituting the roof trusses, which of course can be 2"×6" or 2"×8" timbers in most instances. The underside of the roof trusses are frequently notched at the location where they are directly supported by the plates extending around the top of the wall, thus to create particularly sturdy construction.

With reference again to FIG. 3, it will be noted that we may secure the window frame 52 and the door frame 56 in their respective apertures by the use of long nails driven into the window and door frames before the concrete is poured. Then, when the concrete has set around the long nails, the window and door frames will be held tightly in place. No particular structural forms are required above the window frame 52 and the door frame 56, although rod hangers may be embedded in the top beam.

Figure 4:
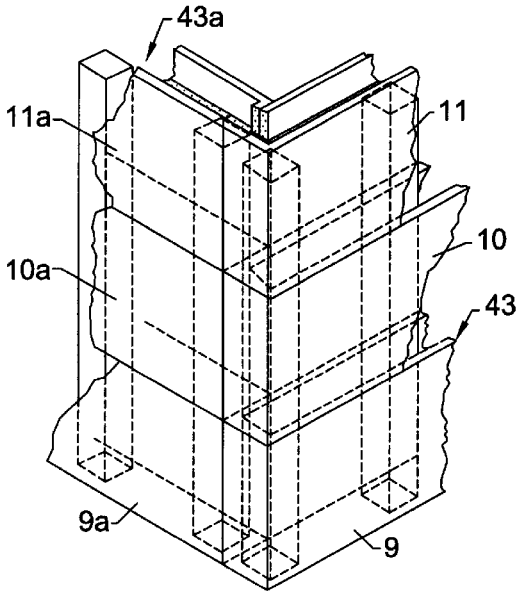
FIG. 4 is a partial perspective view illustrating an intersecting of forms of FIG. 1.
Figure 5:
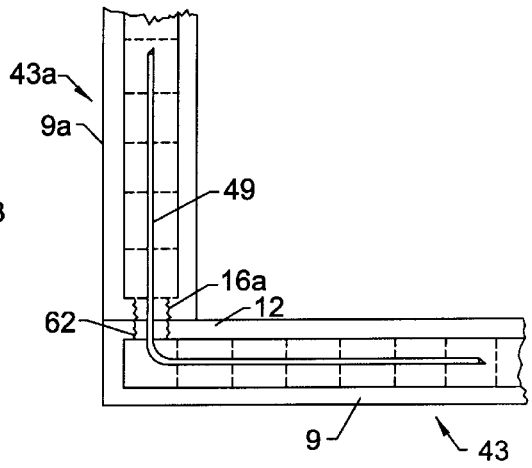
FIG. 5 is a partial top view of a typical corner illustrating how foamed polymeric material is selectively removed to allow for insertion of rebar.

In the construction of a house, apartment, office building or the like, there will be instances in which load-bearing walls are to be interconnected, so special consideration must be given to the manner in which forms 10 in accordance with the invention are joined together laterally as well as vertically in order that sturdy, durable intersections will be created. With reference to FIG. 4, the forms 9, 10, 11 of the wall 43 in an intersecting relationship to lightweight forms 9*a*, 10*a*, 11*a*, respectively, of a wall 43*a* disposed at a 90° angle to the wall 43 constituted by forms 10, 50 and 80. In the circumstance where it is not desirable for the forms 9, 10, 11, to merely reside alongside the forms 9*a*, 10*a*, 11*a*, and not be connected thereto, an arrangement of the type shown in FIG. 5, wherein lowermost form 9 is shown in close contact with the lowermost form 9*a* of the intersecting wall 43*a*. A part 62 of the side wall 12 of the form 9 has deliberately been removed. In addition, the end portion 16*a* of the form 9*a* is broken away, so that concrete can be poured into this intersection location to tightly secure the forms 9 and 9*a* together. Rebar 49 bent approximately into L-shaped configuration are utilized at each corner location, to assure considerable strength. Understandably, the type of construction depicted in FIG. 5 is also utilized at the intersection location of forms 10 and 10*a* as well as at the intersection location of forms 11 and 11*a* in FIG. 4.

Figure 6:
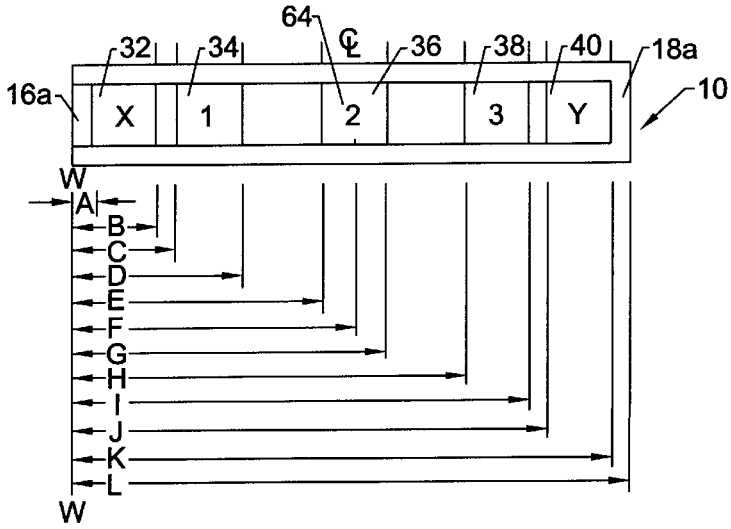
FIG. 6 is a top plan view of the from of FIG. 1.

With particular reference to FIG. 6, it will be noted that we have depicted a typical form 10 in accordance with the present invention which, as mentioned previously, may be 48" in length and 32" in height, and have the elongate, vertically disposed apertures corresponding to apertures 32, 34, 36, 38 and 40, with aperture 36 being disposed in the central location, on a centerline 64 of the form 10. However, to simplify the explanation of this aspect of our invention, instead of utilizing the reference numerals from FIG. 1, we prefer to identify the vertically disposed apertures in FIG. 6 as X, 1, 2, 3 and Y, with elongate aperture 2 corresponding to the central aperture 36 identified in FIG. 1. As will be seen hereinafter by way of example, we typically do not pour concrete in apertures X and Y when pouring on 24" centers, but rather we typically pour in apertures 1 and 3. With regard to the dimensions revealed in FIG. 6, it will be noted that we have defined a line W—W on the left hand side of the depicted form, with dimensions associated with the form being measured from line W—W.

We prefer for the end member 16*a* to be of 2" width, with the far edge of the vertically disposed aperture X extending for 7½" from the line W—W in FIG. 6. Because of this width of the end member 16*a*, the effective width of the vertical aperture X will be seen to be 5½". Although we are not to be limited, we typically prefer for all of apertures X, 1, 2, 3 and Y to be of a width of 5½", and of a height on the order of 24½". As previously mentioned, the resulting columns of concrete are some four times as high as they are wide.

Continuing with FIG. 6, it will be seen that we have utilized the letters A through L to indicate typical dimensions that we may utilize in connection with an exemplary embodiment of our lightweight form when such is of the preferred length, which of course is 48" . It is to be emphasized, however, that these are exemplary dimensions, and we are not to be limited thereto.

A 2"
B 7½"
C 9¼"
D 14¾"
E 21¼"
F 24"
H 33¼"
I 38¾"

J 40½"

K 46"

L 48"

In the example, herein described, when pouring concrete on 24" centers, we typically pour in generally vertically disposed apertures 1 and 3, it is to be understood that the center point of aperture 1 is 12" from line W—W, the center point of aperture 2 is 24" from line W—W, and the center point of aperture 3 is 36" from line W—W.

Although we are not to be limited to pouring concrete into the generally vertically disposed apertures on 24" centers utilizing apertures 1 and 3, we have found that this arrangement is satisfactory in a large number of instances. It is to be understood that when concrete is being poured on 24" centers, holes or apertures X and Y become of lesser importance.

Figure 7:
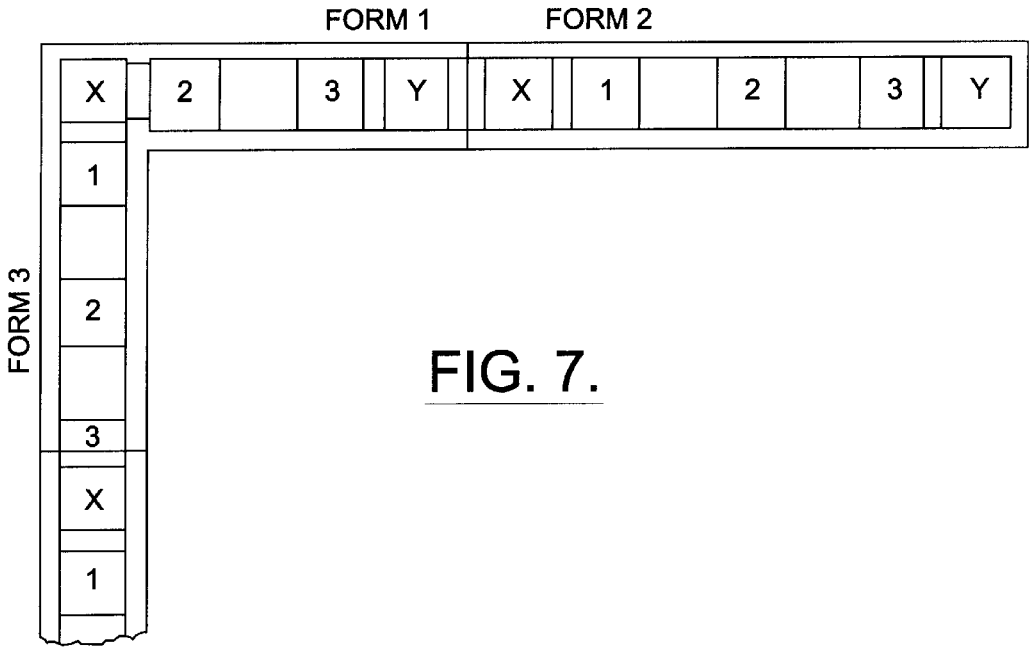
FIG. 7 is a top view illustrating one use of multiple forms of FIG. 1.

In order to join several four foot Styrofoam forms in an end-to-end relationship, we have found it is necessary to cut 21½" off of one end of the first form, which is designated Form 1 in FIG. 7. The construction worker would take a hot wire or saw and cut the form at the location adjacent the hole or aperture 2. The 21½" section of the form or form would then be discarded, or it would perhaps be used elsewhere. As depicted in FIG. 7, a second form (Form 2) is then brought up, with the end of Form 2 being butted up against the end of Form 1. This causes the center of aperture or hole 1 of Form 2 to be located 24" away from the center of hole or aperture 38 of Form 1, and 24" away from the center of hole 3 of Form 2. Similarly, a third form, Form 3, is installed in a right angle relationship to Form 1.

The side of aperture X in Form 3 is cut away down to the floor of the horizontal channel 24, thus to enable the placement of a rebar, preferably of "L" shape to be placed in the corner. Concrete is to be poured at this location so as to form a firm bond between aperture X of Form 3 and aperture 2 of Form 1, this of course being consistent with the construction depicted in FIGS. 4 and 5.

Inasmuch as FIG. 7 does not purport to show the channels 24, no rebar are shown extending between Form 1 and Form 2, but in the typical construction, rebar are placed in the channels 24 extending through these members, with the 2" end members 16*a* and 18*a* shown in FIG. 1 being broken away so that rebar may extend in a generally continuous fashion along the several forms or forms residing in an end-to-end relationship.

The present invention provides a lightweight form lending itself to the rapid yet economical construction of walls, which can be rapidly constructed by the utilization of a series of forms of identical configuration. Each form may for example be approximately three to four times as high as it is wide, with each form of the series being equipped with elongate, generally vertically disposed apertures into which concrete may be poured. The consistency of the placement of the apertures in such forms enables two or more forms to be placed in a stacked relationship such that a series of aligned vertically disposed apertures are defined. By pouring molten concrete into these aligned apertures, a series of vertically disposed, elongate concrete columns of considerable strength are created. The forms may be approximately of the width of an ordinary concrete block wall, and by creating forms that are approximately 32" high, a wall eight feet in height can be created by placing three of these novel forms in a stacked array.

It is to be noted that although we prefer our lightweight forms to be approximately three to four times as high as they are wide, they do not need to be molded in one piece, which is to say that if manufacturing economies warrant, we can make our forms in two 16" sections. Then, after the vertically disposed apertures are carefully in alignment, the upper and lower form sections can be glued or cemented together shortly after the time of manufacture, such that builders will receive forms that are 32" high. We have found that a water base contact cement or polyurethane spray or foam is typically a satisfactory way of securing the upper and lower form sections together. One commercial product usable for this purpose is Foam-Lok, manufactured by Demand Products. A structural adhesive such as Liquid Nails is often satisfactory for securing upper and lower form sections together.

Although we often utilize lightweight structural forms wherein the long sidewalls 12 and 14 are two inches thick, with certain lightweight constructional materials and with certain weight-bearing requirements, we have found that each of the long sidewalls can be one inch thick. When the sidewalls are two inches thick, the form or form is typically 9½" wide, whereas it is to be noted that when the sidewalls are one inch thick, the form or form is typically 7½" wide. Preferably, when the form 10 is 32" high and 48" long, the height of the form is approximately three to four times its width.

Figure 8:
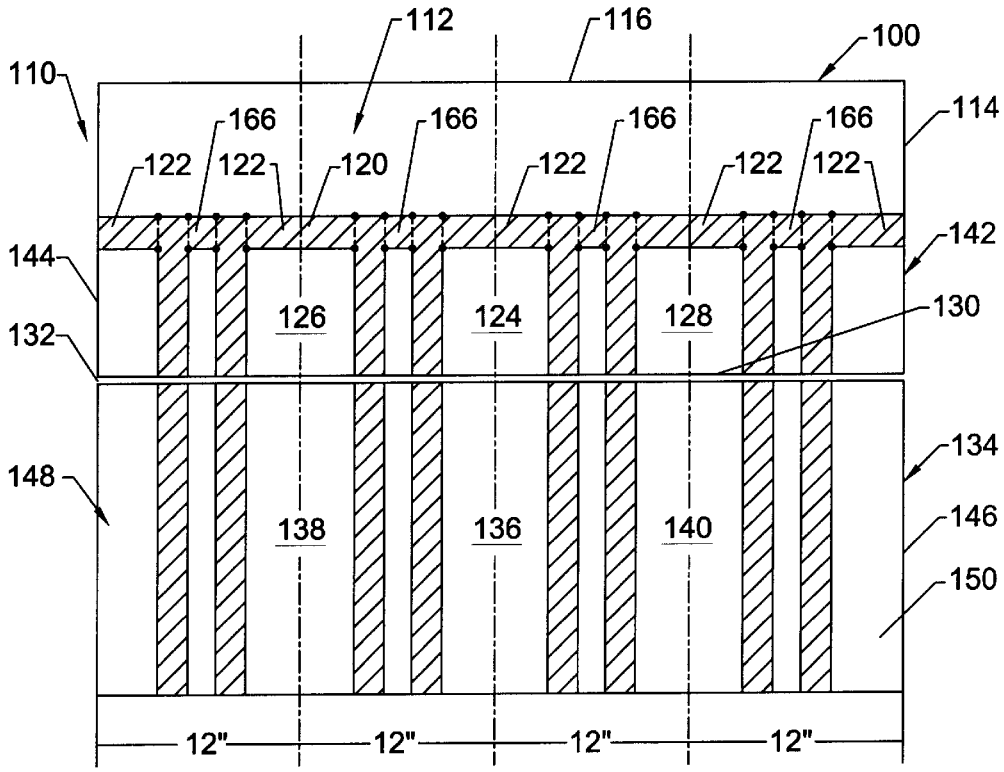
FIG. 8 is a cross-section view illustrating an improved embodiment of the present invention, taken through lines 8—8 of FIG. 9.
Figure 9:
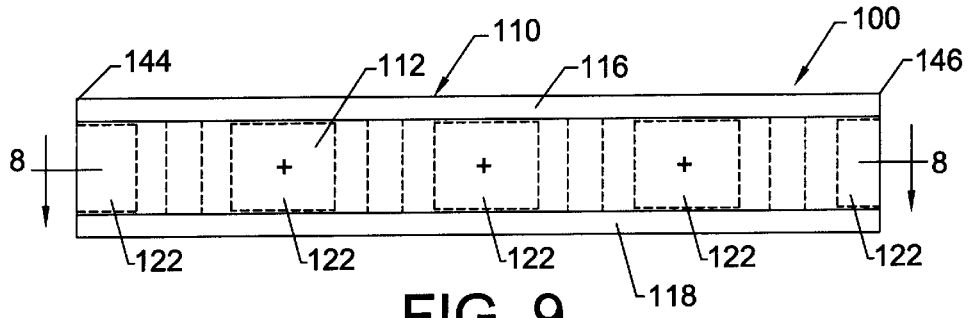
FIG. 9 is a top plan view of the improved embodiment of FIG. 8.
Figure 10:
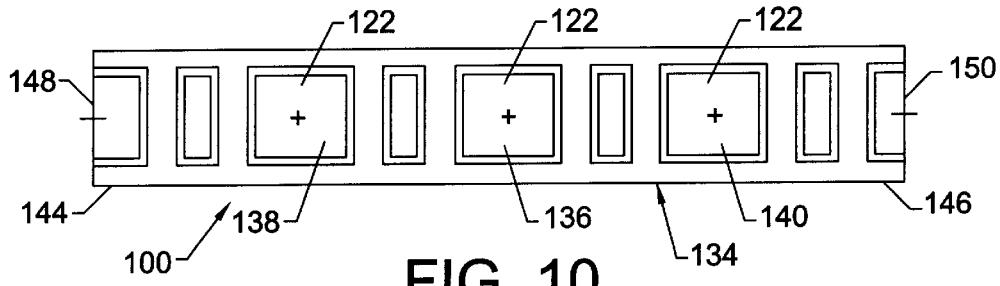
FIG. 10 is a bottom plan view of the embodiment of FIG. 8.

As earlier discussed, it is desirable to align the forms in an off-set manner by incrementally shifting the forms at one foot intervals, as well as the two foot intervals is earlier described with reference to FIG. 1. Improvements to the form 10 described above, have been made to accommodate such one foot incremental shifting in stacked forms, as well as other modifications to be herein described, with reference initially to FIG. 8 for an improved form 100, while keeping with the intent and teachings of the invention. The improved from 100, as illustrated with reference to FIGS. 8–10, is preferably fabricated by an injection molding process using a Styrofoam thermal insulating material. The improved form 100 comprises a lintel block section 110 formed of the insulating material. The lintel block section 110 includes an elongate open ended channel 112 extending along a top portion 114 thereof. The channel 112 is defined by opposing vertical side walls 116, 118 and a bottom wall 120. The bottom wall 120 includes a plurality of plugs 122 therein. The lintel block section 110 also includes a plurality of elongate, vertically disposed apertures, with a center aperture 124, and left and right apertures 126, 128 horizontally displaced from the center aperture by 12" as measured from center to center of each aperture. The apertures 124, 126, and 128 have a generally square cross-section in the embodiment herein described, but other cross-sections, such as oval, circular, and multi-sided, will come to the mind of the user without departing from the intent and teachings of the present invention. The apertures 124, 126, and 128 each an open end 130 at the lower most portion, the bottom 132 of the lintel block section 110. Each of the apertures 124,126, 128 extend upwardly toward the channel bottom wall 120 and are blocked by their respective plugs 122. Each of the apertures terminates at one plug 122 within the bottom wall 120 of the channel 112.

As illustrated with reference again to FIGS. 8–10, the form 100 further includes a post block section 134 for stacking with the lintel block section 110. The post block section 134 is preferably formed of the same insulating material earlier described, and includes three apertures, a center aperture 136, left and right apertures 138,140, vertically disposed and extending entirely through the post block section 134, with the post block section apertures aligned with the lintel block section apertures 124,126, 128 in a first stackable position 142, as illustrated in FIG. 8. By way of example, the form 100 described with reference to FIG. 8, has a 32" height, formed by the two 16" high stacked block sections 110, 134, and has a length dimension of 48", found to be a practical size for manufacture, shipping, storage, and handling.

Figure 11:
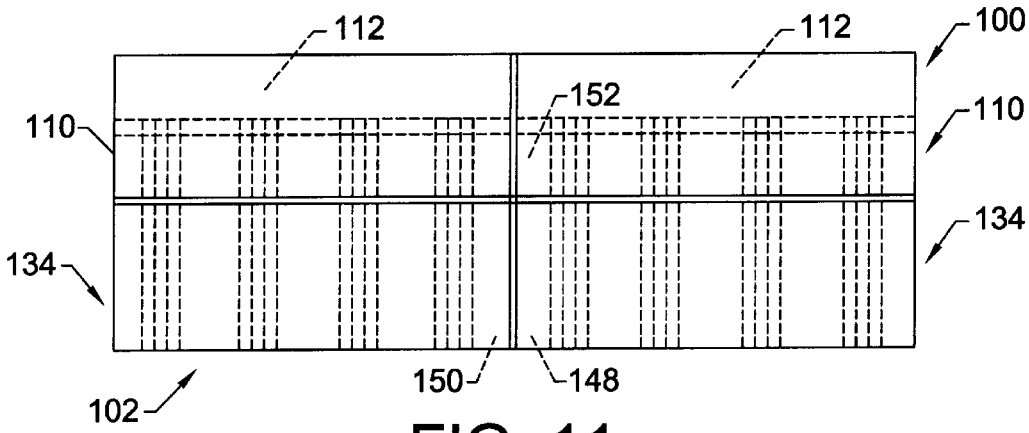
FIG. 11 is an elevation view illustrating multiple stacked forms of FIGS. 8–10.
Figure 12:
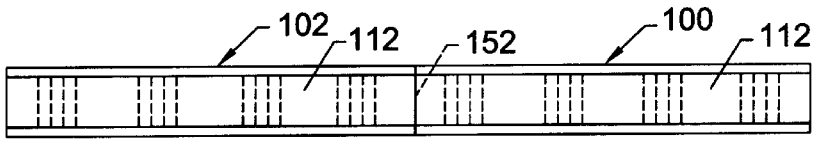
FIG. 12 is a top plan view of FIG. 11.
Figure 13:
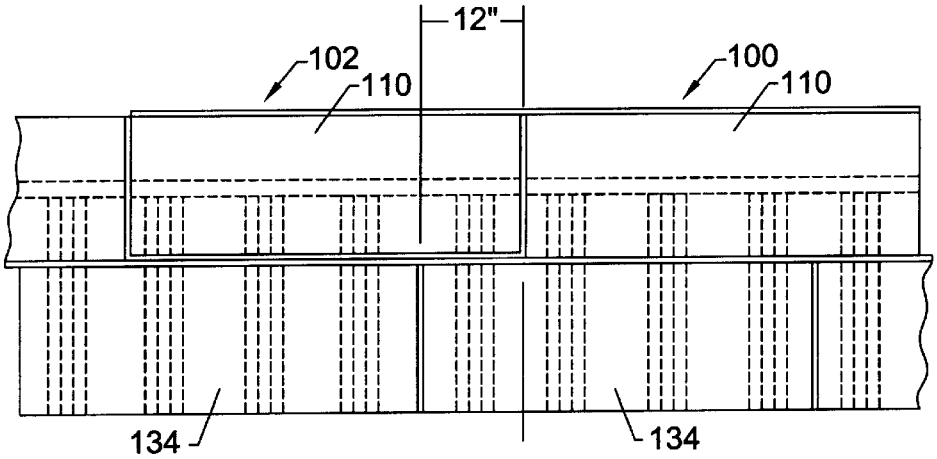
FIG. 13 is an elevation view illustrating multiple off-set form sections for adjoining multiple forms.
Figure 14:
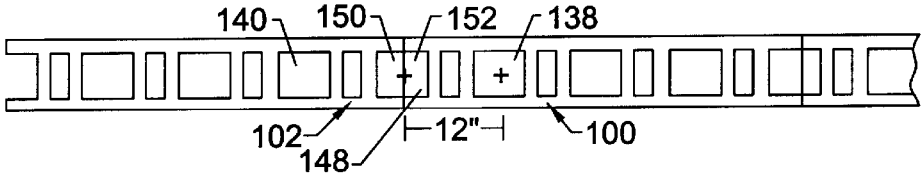
FIG. 14 is a bottom plan view of FIG. 13.
Figure 15:
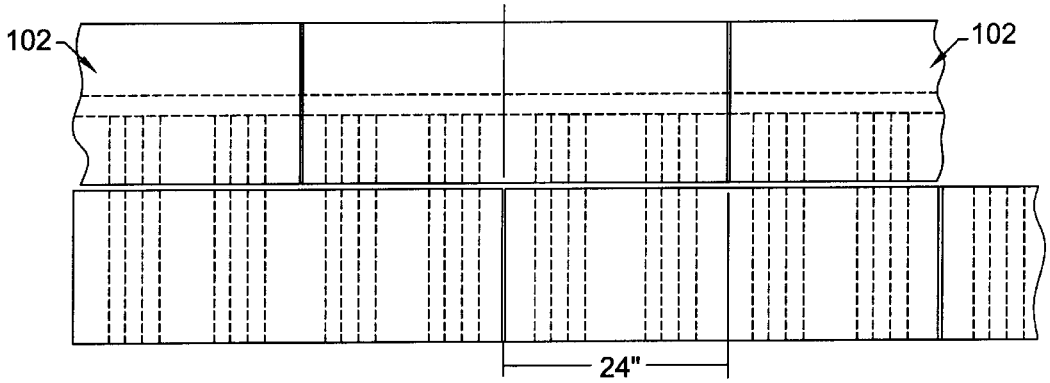
FIGS. 15–17 are elevation, top plan and bottom plan views of an alternate arrangement of multiple off-set form sections for adjoining multiple forms.
Figure 16:
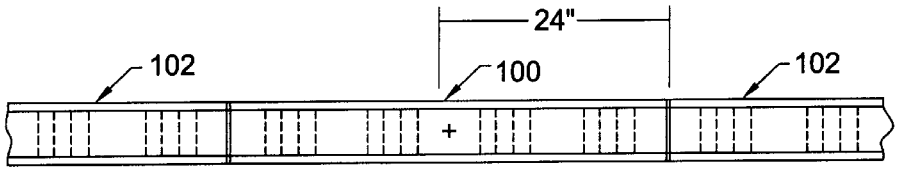
Figure 17:
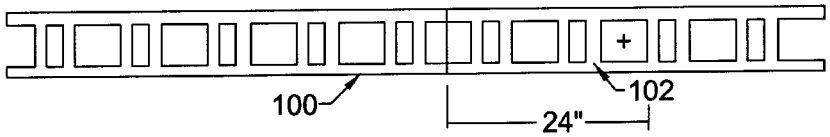

As illustrated with reference again to FIGS. 8–10, the form 100 includes the open ended channel 112. In addition, left and right ends 144, 146 include trough-like passages 148,150, which passages are shaped to provide an aperture 152 when multiple forms 100,102 are longitudinally aligned and, by way of this example, each has its sections 110,134 stacked directly above each other, as illustrated with reference to FIGS. 11 and 12. For the 48" long form 100 herein described, the left and right ends 144, 146 are each 12" from their neighboring apertures 126, 138 and 128, 140, respectively. The passages 148, 150, like the apertures, have plugs 122, half sized plugs, blocking entry vertically from the channel 112 into the passages and thus the aperture 152 formed by the adjoining passages. With the herein described embodiment of FIG. 8, by way of example, a horizontal displacement or off-setting of the lintel block section 110 with the post block section 134 in increments of 12" provides for an alignment of apertures and thus the formation of a post or column from the bottom of the form 100 to the channel bottom wall 120. Twelve inch, a one column off-set, and 24", a two column off-set, for sample off-setting alignments of the lintel and post block sections 110, 134 are illustrated with reference to FIGS. 13, 14 for the 12", and 15, 16, 17 for the 24", respectively.

Figure 18:
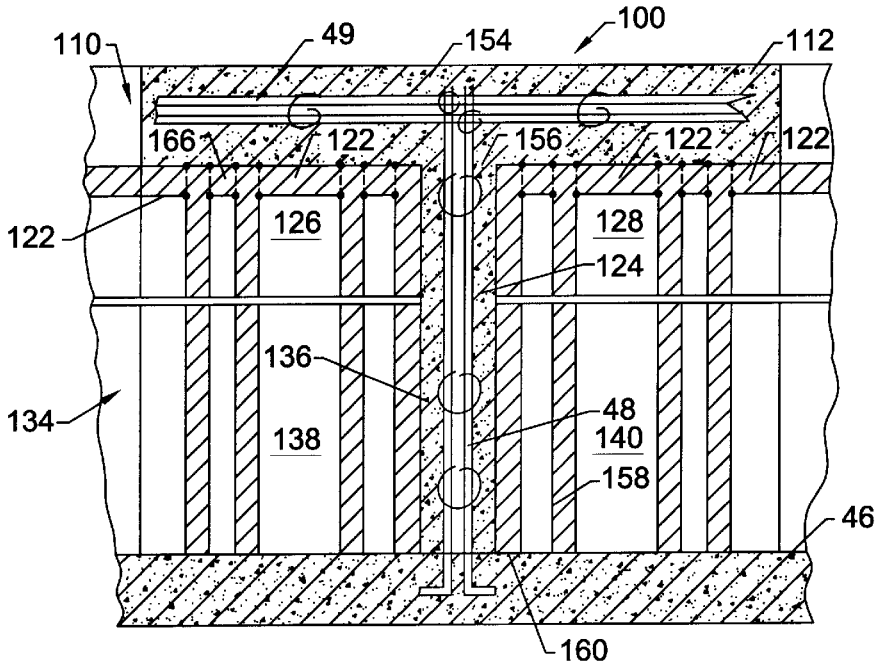
FIG. 18 is a partial cross-section view through a form of the present invention illustrating a poured concrete and rebar arrangement.
Figure 19:
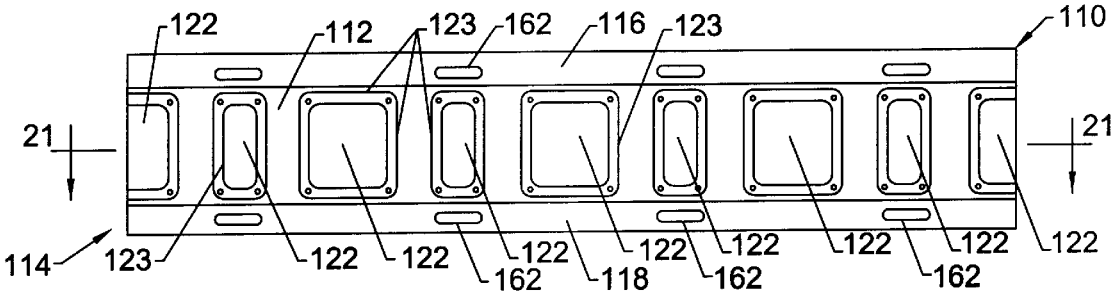
FIG. 19 is a top plan view of a lintel block section of one preferred embodiment of the present invention.
Figure 20:
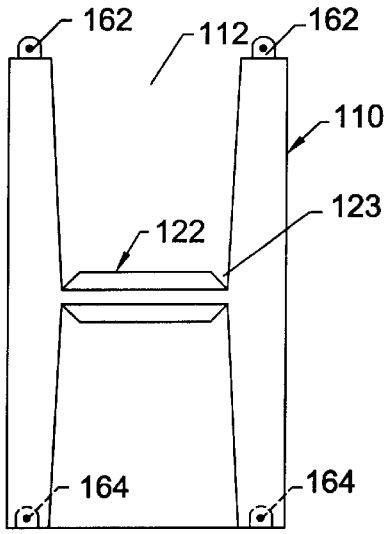
FIG. 20 is an end view of FIG. 19.
Figure 21:
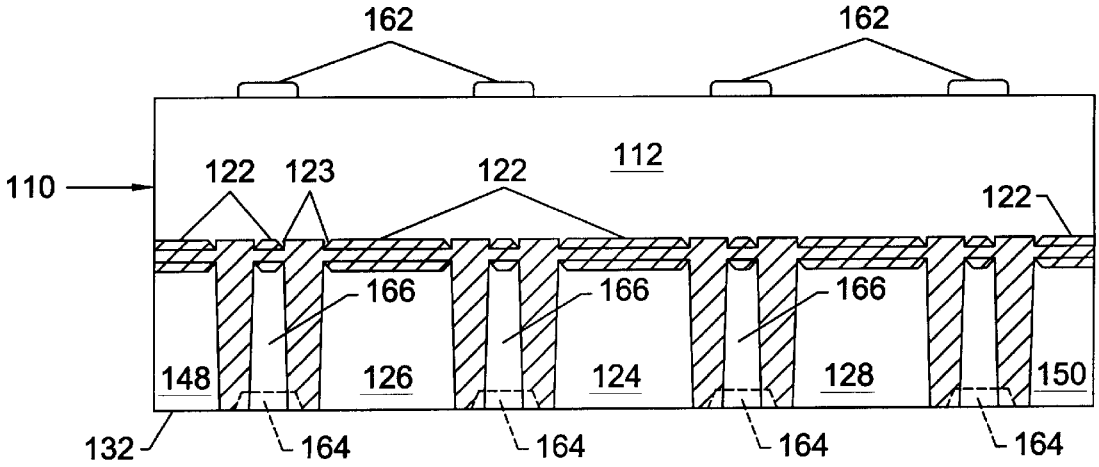
FIG. 21 is a cross-section view taken through lines 21—21 of FIG. 19.
Figure 22:
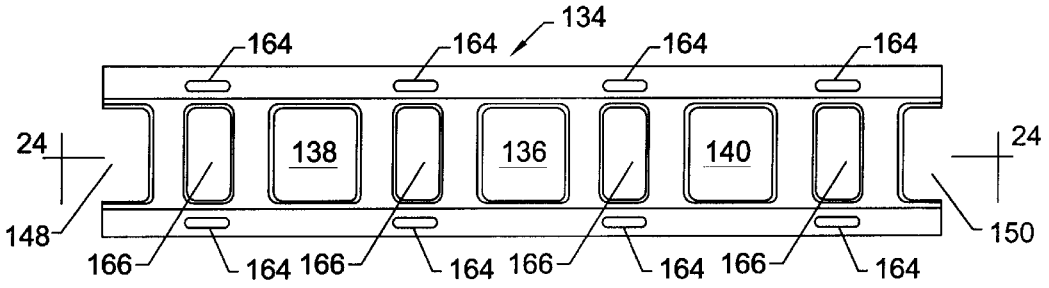
FIG. 22 is a bottom plan view of a post block section operable with the embodiment of FIG. 19.
Figure 23:
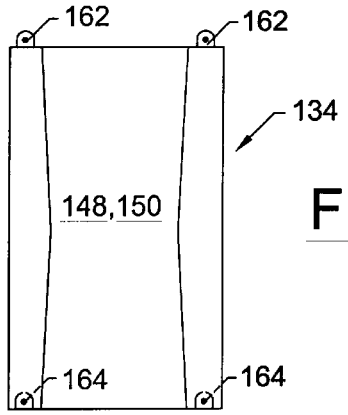
FIG. 23 is an end view of FIG. 22.
Figure 24:
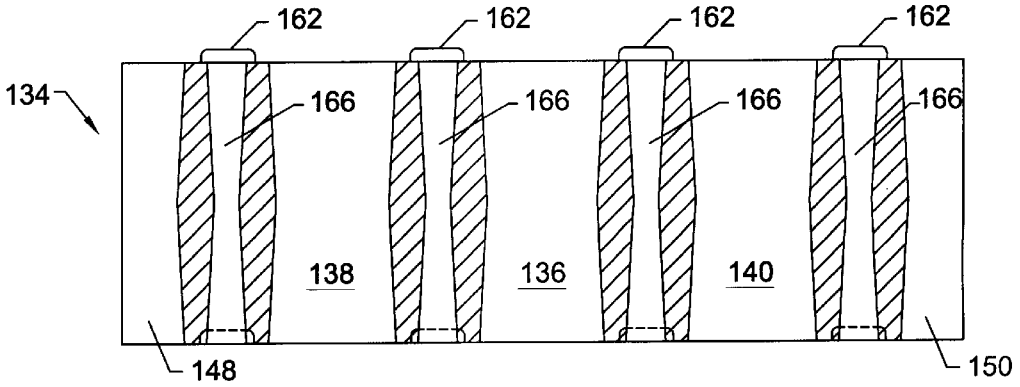
FIG. 24 is a cross-section view taken through lines 24—24 of FIG. 22.

As earlier described for the form 10, and as described here by way of example with reference to FIG. 18, the channel 112 of the form 100 is open ended and adapted to receive a continuous pour of concrete into a trough formed by multiple adjoining forms. The channel 112 will contain the molten concrete 154, with some of the concrete being able to flow into and fill a column formed by selected and aligned apertures 124, 136, when a preselected plug 122 is removed from the bottom wall 120 of the channel to form an opening 156 through which the molten concrete can flow. The concrete filled channel will provide the beam, and the concrete filled apertures will provide the post, in the variable post and beam arrangements provided by the present invention. Rebar 48, 49 will or will not be incorporated into the channel 112 and apertures 124,136 as desired. As further illustrated with reference to FIG. 18, the aperture 136 of the post block section 134 includes generally straight inside walls 158 which extend fully to the bottom planar surface 160 of the post block section 134 for allowing the poured concrete 154 to be vertically set and for avoiding the molten concrete to cause the form 100 to be buoyed upward and lifted out of position.

As illustrated with reference to FIGS. 19–21 and 22–24, a preferred embodiment of the form 100 includes means for interlocking lintel and post block sections 110,134 as well as stacked forms 100. The interlocking means include tongues 162 and grooves 164 placed along top and bottom portions of the sections 10,134, and spaced to accommodate the one foot off-sets earlier described, while interlocking to prevent horizontal movement between sections and adjoining forms. In an alternative, pegs, preferably hard Styrofoam, can be used to interlock the sections and forms. Of further note, walls forming the apertures are outwardly tapered toward the open ends to accommodated ease in ejecting the form sections 10, 134 from their molds during manufacture. As illustrated with reference again to FIGS. 8–10, 19, and 21, the form 100 includes small vertical apertures 166 having similar properties as described for the apertures, including a knockout styled plugs 122 for permitting molten concrete to flow into the small apertures 166 as may be preferred by the builder. For ease in knocking out the plugs 122, and as illustrated with reference again to FIGS. 19–21, the perimeter 168 of each plug 122 includes a reduced thickness 123, sufficient to prevent molten concrete to inadvertently dislodge the plug, permitting a thrust of the hand to easily knock the plug out of its blocking position.

Figure 25:
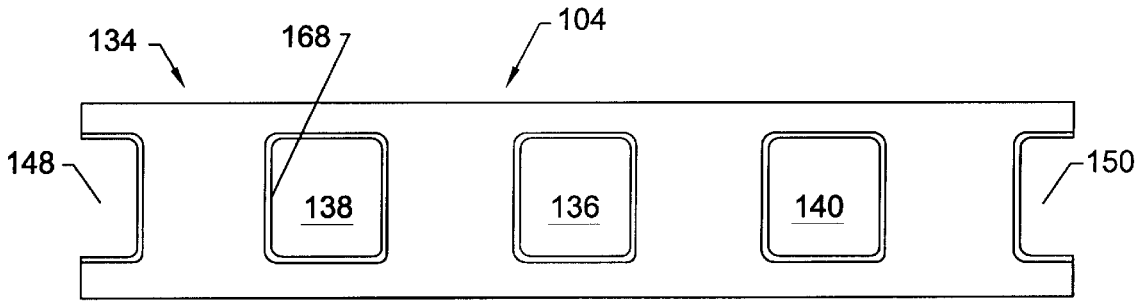
FIG. 25 is a top plan view of an alternate embodiment a post block section of a form of the present invention.
Figure 26:
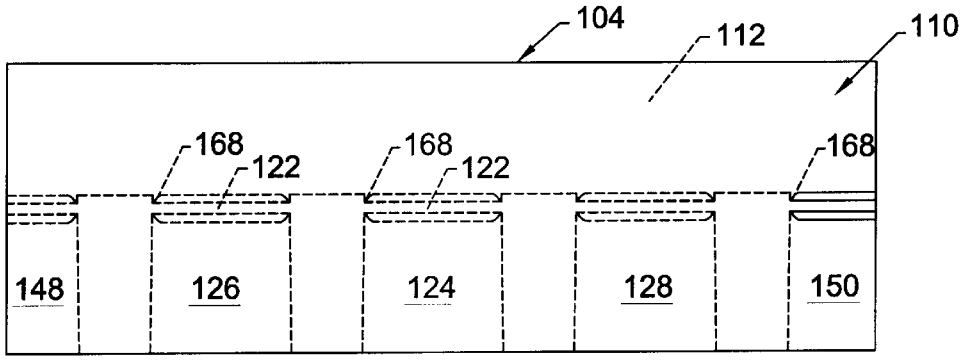
FIG. 26 is a side elevation view of a lintel block section of an alternate embodiment of a form operable with the post block section of FIG. 25.

As illustrated with reference to FIGS. 25 and 26, alternate embodiments of the form 104 may not include the small apertures, or will have the small apertures integrally filled with Styrofoam, and include only the earlier described apertures 124, 126, 128, and 136, 138, 140 as desired to accommodate strength, economy of materials, and need.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

That which is claimed:

1. A lightweight structural form useful in the construction of a thermally insulated load bearing wall, the form comprising:

a lintel block section formed of an insulating material, the lintel block section having an elongate channel horizontally disposed along a top portion thereof, the channel defined by opposing vertical side walls and a bottom wall, the bottom wall having a plurality of knockout styled plugs therein, the lintel block section further having a first set of elongate, generally vertically disposed apertures having an open end at a lower most end of the lintel block section, which vertically disposed apertures extend upwardly to a closed end, each vertically disposed aperture terminating at one knockout styled plug within the bottom wall of the channel; and a post block section operably stackable with the lintel block section, the post block section formed of the insulating material and having a second set of elongate, generally vertically disposed apertures extending therethrough, wherein the first and second sets of elongate apertures are aligned in a first stackable position, and wherein a horizontal off-set in increments of one foot provides an alignment of at least one aperture of the first and second sets of elongate apertures, and wherein the channel is adapted to receive and contain molten concrete, with some of the concrete being able to flow into and fill a selected aperture of the first and second sets of vertically disposed apertures, when a selected plug is removed from the bottom wall, which selected plug is above the selected aperture to be filled with the molten concrete, such that an elongate supporting column of concrete extending through the aligned apertures of both block sections will be created when the concrete dries and becomes hard.

2. A form according to claim 1, wherein the elongate channel is open ended and extends a full length of the form.

3. A form according to claim 1, further comprising interlocking means carried along top and bottom portions of the lintel and post block sections, the interlocking means positioned for providing alignment of the first and second sets of elongate vertically disposed apertures while interlocking to prevent horizontal movement between lintel; and post block sections and adjoining forms.

4. A form according to claim 3, wherein the interlocking means comprises a tongue and groove.

5. A form according to claim 1, wherein a perimeter defining each knockout styled plug includes a reduced bottom wall thickness sufficient to prevent molten concrete from dislodging the plug, while permitting a thrust of the hand to easily knock the plug out of its blocking position.

6. A form according to claim 1, wherein the first and second sets of vertically disposed elongate apertures include one aperture located within a center portion of the block sections and remaining apertures arranged in a symmetric relation thereto.

7. A form according to claim 6, wherein each of the lintel and post block sections include vertically disposed trough-like passages within end portions of the respective block section, which passages are shaped to provide a vertically disposed aperture for juxtaposed forms placed end to end, the lintel block section further having a half plug within the trough-like passage, which half plug mates with an adjacent half plug within the juxtaposed block sections, thus blocking entry into the passages from the channel and thus the aperture formed by the adjoining passages.

8. A form according to claim 1, wherein the lintel and post block sections further include an intermediate set of elongate, generally vertically disposed apertures extending therethrough, the intermediate apertures of the lintel block section aligning with the intermediate apertures of the post block section when the aperture of the first and second sets of elongate apertures are aligned, and wherein the intermediate set of elongate apertures within the lintel block section terminate at closed end proximate the channel, the closed end including the knockout styled plug therein for access to the channel.

9. A form according to claim 1, wherein at least three elongate, generally vertically disposed apertures are disposed therein, and wherein the apertures are located on one foot centers.

10. A form according to claim 1, wherein the lintel block and post block sections comprise polystyrene material.

11. A lightweight structural form useful in the construction of a thermally insulated load bearing wall, the form comprising:

a lintel block section having an elongate channel horizontally disposed along a top portion thereof, the channel formed with a bottom wall having a plurality of knockout styled plugs therein, the lintel block section further having a plurality of elongate, generally vertically disposed apertures having an open end at a lower most end, which vertically disposed apertures extend upwardly to a closed end terminating at one knockout styled plug within the bottom wall of the channel; and a post block section operably stackable with the lintel block section, the post block section having a plurality of elongate, generally vertically disposed apertures extending therethrough, wherein the lintel block and post block sections may be stacked having the plurality of elongate apertures of each section in alignment, and wherein the channel is adapted to receive and contain molten concrete, with some of the molten concrete flowing into and filling a selected aperture of the lintel and post block section when a selected plug is removed from the bottom wall such that an elongate supporting column of concrete extending through the aligned apertures of both block sections will be created when the concrete dries and becomes hard.

12. A form according to claim 11, wherein the elongate channel is open ended and extends a full length of the form.

13. A form according to claim 11, further comprising interlocking means carried along top and bottom portions of the lintel and post block sections, the interlocking means positioned for providing alignment of the first and second sets of elongate vertically disposed apertures while interlocking to prevent horizontal movement between lintel; and post block sections and adjoining forms.

14. A form according to claim 13, wherein the interlocking means comprises a tongue and groove.

15. A form according to claim 11, wherein a perimeter defining each knockout styled plug includes a reduced bottom wall thickness sufficient to prevent molten concrete from dislodging the plug, while permitting a thrust of the hand to easily knock the plug out of its blocking position.

16. A form according to claim 11, wherein the plurality of elongate apertures for each of the lintel and post block sections include one aperture located within a center portion of the block sections and remaining apertures arranged in a symmetric relation thereto.

17. A form according to claim 16, wherein each of the lintel and post block sections include vertically disposed trough-like passages within end portions of the respective block section, which passages are shaped to provide a vertically disposed aperture for juxtaposed forms placed end to end, the lintel block section further having a half plug within the trough-like passage, which half plug mates with an adjacent half plug within the juxtaposed block sections, thus blocking entry into the passages from the channel and thus the aperture formed by the adjoining passages.

18. A form according to claim 11, wherein the lintel and post block sections further include an intermediate set of elongate, generally vertically disposed apertures extending therethrough, the intermediate apertures of the lintel block section aligning with the intermediate apertures of the post block section when a single aperture of the first and second sets of elongate apertures are aligned.

19. A form according to claim 18, wherein the intermediate set of elongate apertures within the lintel block section terminate at closed end proximate the channel, the closed end including the knockout styled plug therein for access to the channel.

20. A form according to claim 11, wherein at least three elongate, generally vertically disposed apertures are disposed therein, and wherein the apertures are located on one foot centers.

21. A form according to claim 11, wherein the lintel block and post block sections comprise are formed substantially from a polystyrene material.

22. A method of forming a thermally insulated load bearing wall, the method comprising he steps of:

providing a post block section formed from an insulating material, the post block section having a plurality of elongate, generally vertically disposed apertures extending therethrough;

providing a lintel block section having a plurality of elongate, generally vertically disposed apertures having an open end at a lower most end, wherein the lintel block and post block sections may be stacked having the plurality of elongate apertures of each section in alignment, wherein the elongate apertures within the lintel block section extend upwardly to a closed end terminating at a bottom wall of a channel horizontally disposed along a top portion of the lintel block section, the channel formed from a bottom wall having one knockout styled plug positioned for accessing the elongate aperture therethrough an opening formed when the plug is removed;

placing the post block section onto a supporting surface;

placing the lintel block section onto the post block section in a stacked arrangement with at least one of the plurality of elongate apertures from each section in alignment;

removing a selected knockout plug form a selected aperture for providing the opening from the channel to the selected aperture; and pouring contain molten concrete into the channel, with at least some of the molten concrete flowing into and filling the selected aperture of the lintel and post block section such that an elongate supporting column of concrete extends through the aligned apertures of both block sections for forming a support column when the concrete dries and becomes hard.

23. A method according to claim 22, wherein the lintel block section placing step comprises the step of placing first and second lintel block sections end to end and onto the post block section, and wherein the channel within the lintel block section is open ended and extends a full length of the form for providing a continuous channel between the first and second lintel block sections.

24. A method according to claim 23, wherein each of the lintel and post block sections include vertically disposed trough-like passages within end portions of the respective block section, which passages are shaped to provide a vertically disposed aperture for juxtaposed forms placed end to end, the lintel block section further having a half plug within the trough-like passage, which half plug mates with an adjacent half plug within the juxtaposed block sections, thus blocking entry into the passages from the channel and thus the aperture formed by the adjoining passages.

25. A method according to claim 22, further comprising the step of interlocking top and bottom portions of the lintel and post block sections.

26. A method according to claim 25, wherein the interlocking step comprises the step of positioning a tongue within a groove, the tongue and groove carried by the lintel and post block sections.

27. A method according to claim 22, wherein the knockout plug removing step comprises the step of knocking out the plug with a thrust of the hand, and wherein a perimeter defining each knockout styled plug includes a reduced bottom wall thickness sufficient to prevent molten concrete from dislodging the plug, while permitting the thrust of the hand to easily knock the plug out of its blocking position.

28. A method according to claim 22, wherein the plurality of elongate apertures for each of the lintel and post block sections include one aperture located within a center portion of the block sections and remaining apertures arranged in a symmetric relation thereto.

29. A method according to claim 22, wherein the lintel and post block sections further include an intermediate set of elongate, generally vertically disposed apertures extending therethrough, the intermediate apertures of the lintel block section aligning with the intermediate apertures of the post block section when a single aperture of the first and second sets of elongate apertures are aligned.

30. A method according to claim 29, wherein the intermediate set of elongate apertures within the lintel block section terminate at closed end proximate the channel, the closed end including the knockout styled plug therein for access to the channel.

31. A form according to claim 22, wherein at least three elongate, generally vertically disposed apertures are disposed therein, and wherein the apertures are located on one foot centers, and wherein the lintel placing step comprises the step of offsetting aligning of apertures of the lintel block section from apertures in the post block section by one foot.

* * * * *